US011375764B2

(12) United States Patent
Neal et al.

(10) Patent No.: US 11,375,764 B2
(45) Date of Patent: Jul. 5, 2022

(54) SHOCK ABSORPTIVE HELMET—FACEMASK INTERCONNECT

(71) Applicant: Cincyguys, LLC, Liberty Township, OH (US)

(72) Inventors: Braxton Neal, Cincinati, OH (US); Nathan Guard, Liberty Township, OH (US)

(73) Assignee: Cincyguys, LLC, Liberty Township, OH (US)

( * ) Notice: Subject to any disclaimer, the term of this patent is extended or adjusted under 35 U.S.C. 154(b) by 489 days.

(21) Appl. No.: 16/451,006

(22) Filed: Jun. 25, 2019

(65) Prior Publication Data

US 2019/0307201 A1 Oct. 10, 2019

Related U.S. Application Data

(63) Continuation-in-part of application No. 15/824,197, filed on Nov. 28, 2017, now Pat. No. 10,694,803.

(51) Int. Cl.

| | |
|---|---|
| ***A42B 3/20*** | (2006.01) |
| ***A42B 3/06*** | (2006.01) |
| ***A44B 3/08*** | (2006.01) |
| ***A44B 99/00*** | (2010.01) |
| *A63B 71/10* | (2006.01) |

(52) U.S. Cl.
CPC ..... *A42B 3/20* (2013.01); *A42B 3/06* (2013.01); *A44B 3/08* (2013.01); *A44B 99/00* (2013.01); *A63B 71/10* (2013.01)

(58) Field of Classification Search
CPC .. A42B 3/20; A42B 3/06; A44B 99/00; A63B 71/10
See application file for complete search history.

(56) References Cited

U.S. PATENT DOCUMENTS

| | | | | |
|---|---|---|---|---|
| 3,900,897 A | | 8/1975 | Dunning | |
| 4,136,403 A | | 1/1979 | Walther | |
| 4,363,140 A | * | 12/1982 | Correale | A42B 3/20 2/9 |
| 4,370,759 A | * | 2/1983 | Zide | A42B 3/20 2/9 |
| 4,837,866 A | | 6/1989 | Rector et al. | |
| 5,095,552 A | * | 3/1992 | Parkinson | A42B 3/20 2/9 |
| 5,537,687 A | | 7/1996 | Garza | |

(Continued)

FOREIGN PATENT DOCUMENTS

| | | |
|---|---|---|
| WO | 2017040427 A1 | 3/2017 |
| WO | 2017074206 A1 | 5/2017 |

*Primary Examiner* — Tajash D Patel
(74) *Attorney, Agent, or Firm* — Richard A. Baker, Jr.

(57) ABSTRACT

A unique attachment mechanism to connect a facemask to a helmet is described. This attachment mechanism uses a polymer urethane visco-elastic, or similar, material to absorb impact forces on the facemask to minimize injury for the person using the helmet. In some embodiments, a spring and bearing mechanism is used in conjunction with the polymer urethane visco-elastic material to further absorb forces. In another embodiment, a polymer urethane visco-elastic grommet on a screw is used for an upper attachment of the mask to the helmet, and a larger polymer urethane visco-elastic structure with an internal spring is used as the lower attachment between the helmet and the mask. In still another embodiment, the connection between the helmet and the mast is a U shaped structure with a flat spring enclosed.

19 Claims, 13 Drawing Sheets

(56) References Cited

U.S. PATENT DOCUMENTS

| | | | | |
|---|---|---|---|---|
| 5,956,777 | A | 9/1999 | Popovich | |
| 6,934,971 | B2 | 8/2005 | Ide et al. | |
| 7,036,151 | B2 | 5/2006 | Ide et al. | |
| 7,607,179 | B2 | 10/2009 | Shih | |
| 8,209,784 | B2 | 7/2012 | Nimmons et al. | |
| 9,474,316 | B2 | 10/2016 | Berry | |
| 9,474,317 | B2 | 10/2016 | Berry | |
| 9,648,920 | B1 | 5/2017 | Kuntz | |
| 9,687,037 | B1 | 6/2017 | Colello et al. | |
| 9,750,298 | B2 | 9/2017 | Summerville | |
| 9,959,523 | B2 | 5/2018 | Klein | |
| 10,092,057 | B2 | 10/2018 | Kovarik et al. | |
| 10,188,168 | B2 | 1/2019 | Tubbs | |
| 10,244,809 | B2 | 4/2019 | Linares | |
| 10,694,803 | B2 * | 6/2020 | Neal | A63B 71/10 |
| 11,266,197 | B2 * | 3/2022 | Tatomir | A42B 3/221 |
| 2008/0163410 | A1 | 7/2008 | Udelhofen | |
| 2008/0313791 | A1 | 12/2008 | Nagely | |
| 2009/0106882 | A1 | 4/2009 | Nimmons et al. | |
| 2011/0061152 | A1 | 3/2011 | Wismann | |
| 2011/0209272 | A1 | 9/2011 | Drake | |
| 2012/0255096 | A1 | 10/2012 | Westley | |
| 2013/0212783 | A1 | 8/2013 | Bonin et al. | |
| 2014/0101829 | A1 | 4/2014 | Witcher | |
| 2014/0201889 | A1 | 7/2014 | Pietrzak et al. | |
| 2014/0310857 | A1 | 10/2014 | Lastik et al. | |
| 2015/0201695 | A1 | 7/2015 | Shih | |
| 2015/0305431 | A1 | 10/2015 | Rush | |
| 2016/0029733 | A1 | 2/2016 | Kovarik et al. | |
| 2018/0125141 | A1 | 5/2018 | Summerville | |
| 2019/0282777 | A1 | 9/2019 | Kwok | |

* cited by examiner

SHOCK ABSORPTIVE HELMET—FACEMASK INTERCONNECT

RELATED APPLICATIONS

This application is a continuation-in-part of U.S. patent application Ser. No. 15/824,197, "Shock Absorptive Face Mask", filed on Jul. 26, 2018.

BACKGROUND

Technical Field

The devices described herein are directed to helmets, and more specifically to mounting mechanisms for attaching facemasks to the helmet.

Description of the Related Art

Worldwide, contact sports are popular among the populations, drawing millions of participants and hundreds of millions of speculators. In the United States, American football is revered. In Canada and northern USA, hockey is a passion. Camogie, hurling, cricket, lacrosse and baseball also have contact elements. But as full contact sports became more popular, the force of the impact between players became greater. And the number of injuries from contact increased. Players responded to the injuries by using pads, helmets and other gear to reduce the number and severity of the injuries.

In recent years, there has been a focus on chronic traumatic encephalopathy (CTE). CTE is a neurodegenerative disease found in people who have had multiple head injuries. It is most commonly found in those who have participated in contact sports on a regular basis.

Sport helmets first started as leather caps in the late 1800s, and extended into hardened leather. 1917 marked the first time helmets were raised above the head in an attempt to direct blows away from the top of the head. Ear flaps also had their downfall during this period as they had little ventilation and made it difficult for players to hear. The 1920s marked the first time that helmets were widely used in the sport of football. These helmets were made of leather and had some padding on the inside, but the padding was insufficient and provided little protection. In addition, they lacked facemasks. As a result, injuries were very common. Early helmets also absorbed a lot of heat, making them very uncomfortable to wear.

In 1939, the Riddell Company of Chicago, Ill. started manufacturing plastic helmets because it felt that plastic helmets would be safer than those made of leather. Plastic was found to be more effective because it held its shape when full collision contact occurred on a play. These helmets were also much more comfortable and had more padding to cushion the head in an impact. Included with the plastic helmet came plastic facemasks, which allowed the helmet to protect the entire head. By the mid-1940s, helmets were required in the National Football League ("NFL"). They were still made of leather, but with improved manufacturing techniques had assumed their more familiar spherical shape. The NFL initially allowed either plastic or leather helmets, but in 1948 the league outlawed the plastic helmet, considering the hard-plastic material to be an injury risk. The NFL repealed this rule in 1949, and by 1950, the plastic helmet had become universal in that league.

By the 1950s, the introduction of polymers ended the leather helmet era. The last leather helmet manufacturer, MacGregor, ceased production of leather helmets in the mid-1960s. The NFL also recommended facemasks for players in 1955, reducing the number of broken noses and teeth.

Since the 1950s, helmets have moved into other sports, such as catcher's masks and batter helmets in baseball, hockey, camogie, hurling, cricket, and lacrosse. Helmet technology is also used in motorcycle helmets, police riot gear, firemen's helmets, and military gear.

In addition, the technology used for helmets has been further refined, with enhanced shapes and materials on the helmet itself. The facemasks initially started as plastic bars that evolved into steel with rubber or plastic coatings. Facemasks were traditionally held onto the helmet with snaps or connectors. Some helmets permanently riveted the facemask to the helmet. Some recent developments used springs to connect the mask with the helmet.

However, these attachment schemes transfer significant amount of force from the facemask to the player's helmet, resulting in either neck injuries from the rapid movement of the players head in a collision, or head/brain injuries as the force is absorbed by the head. The spring connection starts to address this problem, but suffers from the abilities of a spring to absorb all of the force. A better attachment scheme between the helmet and the facemask is required to reduce the force transmitted from the facemask to the helmet.

With the recent focus on CTE injuries, there is a strong need to find better materials and structures for helmets to reduce the number and severity of injuries in contact sports.

The present invention, eliminates the issues articulated above as well as other issues with the currently known products.

SUMMARY OF THE INVENTION

A system for attaching a helmet to a facemask is described herein. The system is made up of a upper attachment and a lower attachments. The upper attachment is made up of a polymer urethane visco-elastic grommet in the shape of a right circular hollow cylinder, placed tightly within a hole in the mask, a screw inserted in the grommet and through a hole in the helmet; and a nut connected to the screw. The lower attachment is made up of a polymer urethane visco-elastic structure in a shape of a rectangular cuboid, the structure resting against the mask; a screw inserted in the structure and through another hole in the helmet; and a nut connected to the screw.

In some embodiments, the structure has a slit removed from one side. In other embodiments, the structure has a round hole removed from the side with the slit. A spring could be inserted in the round hole. The system could also have a second upper attachment, identical to the first, located on the other side. It could also have a second lower attachment on the other side of the mask and helmet, identical to the first.

An apparatus to connect a facemask to a helmet made up of a polymer urethane visco-elastic grommet in the shape of a right circular hollow cylinder, placed tightly within a hole in the mask, a screw inserted in the grommet and through a hole in the helmet; and a nut connected to the screw.

The screw could attach the mask to the helmet near the top of the mask. The helmet could be an American football helmet, a hockey helmet, a lacrosse helmet, a baseball helmet or a motorcycle helmet.

An apparatus to connect a facemask to a helmet, that is made up of a polymer urethane visco-elastic structure in a shape of a rectangular cuboid, the structure resting against the mask, a screw inserted in the grommet and through a hole in the helmet, and a nut connected to the screw.

In one embodiment the mask rests against the structure near the bottom of the mask. The helmet could be an American football helmet, a hockey helmet, a lacrosse helmet, a baseball helmet or a motorcycle helmet. The structure could have a slit removed from one side and could have a round hole removed from the side with the slit. A spring could be inserted in the round hole.

A apparatus for attaching a helmet to a facemask is described here. The apparatus is made up of a polymer urethane visco-elastic structure in a U shape on each of two sides where the two sides are parallel, the structure resting against the facemask and against the helmet. A first screw is inserted in the structure and through a first hole in the helmet, with a first nut connected to the first screw. A second screw is inserted in the structure and through a first loop in the facemask with a second nut connected to the second screw.

In some embodiments, the structure has a slot removed from a side perpendicular to the U shape, inside of the U shape. The structure could have a spring inserted in the slot. The spring could be a flat spring. The first screw and the second screw could be inserted through a loop in the spring.

In some embodiments, the apparatus could also include a polymer urethane visco-elastic grommet in a shape of a right circular hollow cylinder, placed tightly within the first hole in the helmet, where the first screw is inserted in the grommet and through a hole in the helmet, held in place with the first nut.

In some embodiments, the apparatus could be a polymer urethane visco-elastic grommet in a shape of a right circular hollow cylinder, placed tightly within the first loop in the facemask, where the second screw is inserted in the grommet and through the first loop in the facemask, held in place with the second nut.

The first and/or second nut could be a T-nut.

A method of connecting a facemask to a helmet is also described herein. The method is made up of the steps of (1) inserting a first screw through a polymer urethane visco-elastic structure and through a hole in the helmet, there the structure is in a U shape on each side, and where the two sides are parallel, the structure resting against the helmet, (2) connecting a first nut to the first screw, thereby holding the structure to the helmet, (3) inserting a second screw through the structure and through a loop in the facemask, and (4) connecting a second nut to the second screw, thereby holding the structure to the facemask.

BRIEF DESCRIPTION OF FIGURES

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE INVENTION

In one aspect of the invention provides an attachment mechanism between a helmet and a facemask that provides for the absorption of impact forces so as to minimize injury to user of the helmet. There are many types of helmets, and the inventions described herein could be used on any of these, and other helmets. In the following embodiment, the description focuses on an American football helmet as an example, but the inventions could also be used on helmets for hockey, camogie, hurling, cricket, lacrosse and baseball, as well as other sports. The inventions could also be used on motorcycle, motocross, bicycle, ATV, snowmobile, automobile race, aviation, military, police, fire and other helmets.

Adhesive Embodiment

Figure 1:
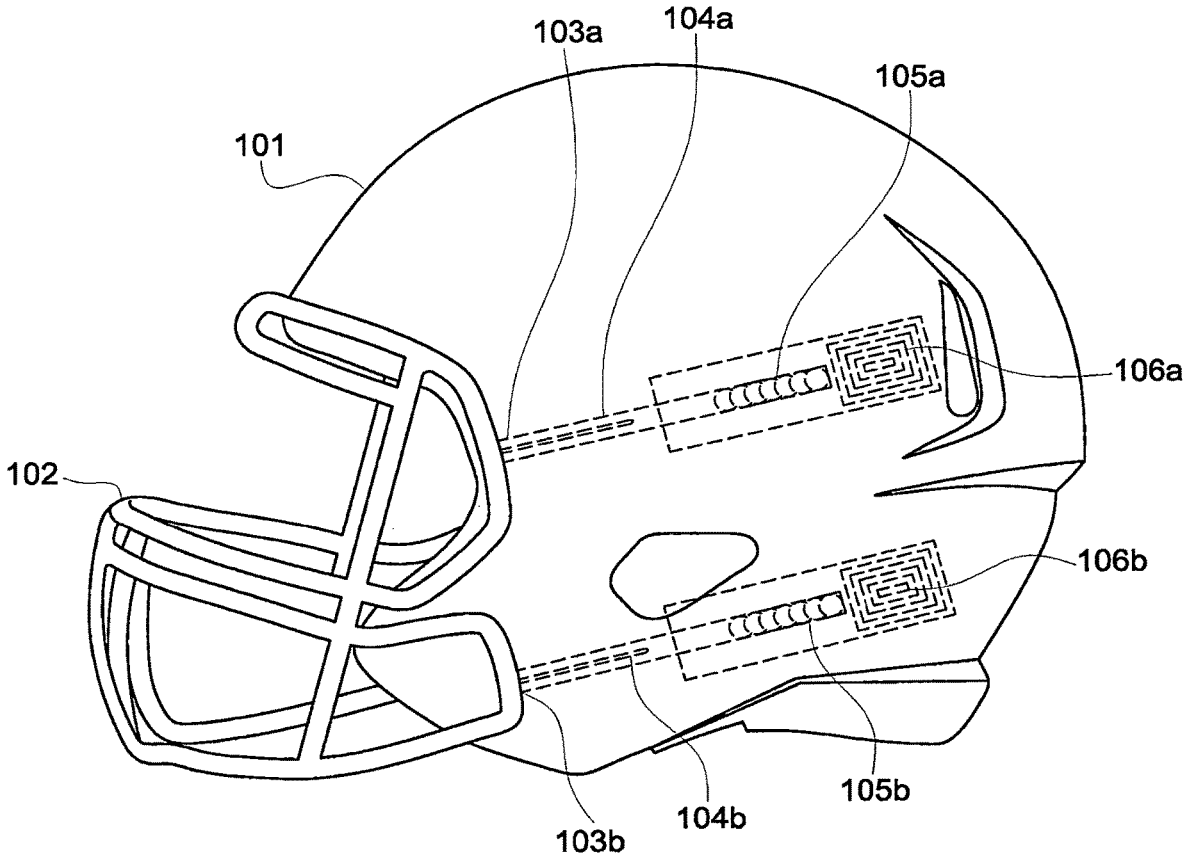
FIG. 1 is an image of a football helmet with the shock absorption facemask attachment.

As an example, see the American football helmet in FIG. 1. The helmet 101 is made of a hard plastic (ABS, polycarbonate, etc.) shell with thick padding on the inside. Other embodiments have the helmet made of leather, metals, or other materials. The helmet 101 has as facemask 102. The facemask 102 is made of polycarbonate, cellulose acetate, metal, or other materials. The facemask 102 is attached to the helmet 101 with four mask attachments 103*a*, 103*b* (only two attachments are shown in the drawing, the other two are on the opposite side of the helmet 101). The four mask attachments 103*a*, 103*b* are connected to the facemask 102 either as part of the molding of the facemask, welded to the mask, or attached to the facemask with rivets or screws. The attachments could be attached to the exterior or interior of the helmet. In another embodiment, the some of the attachments could be inside of the helmet while other are mounted to the outside. The four mask attachments 103*a*, 103*b* slide into the four bearing rails 104*a*, 104*b* and are held in place with a ball bearing. At the end of the four bearing rails 104*a*, 104*b* opposite the facemask 102, the bearing rails 104*a*, 104*b* are mechanically connected to a spring 105*a*, 105*b*. The springs 105*a*, 105*b* are then connected to a polymer urethane visco-elastic material such as Sobathane 106*a*, 106*b*. The Sobathane material 106*a*, 106*b* is glued to the side of the helmet 101. While four attachments are shown in this embodiment, the number of attachments could be varied without deviating from this invention.

Figure 2:
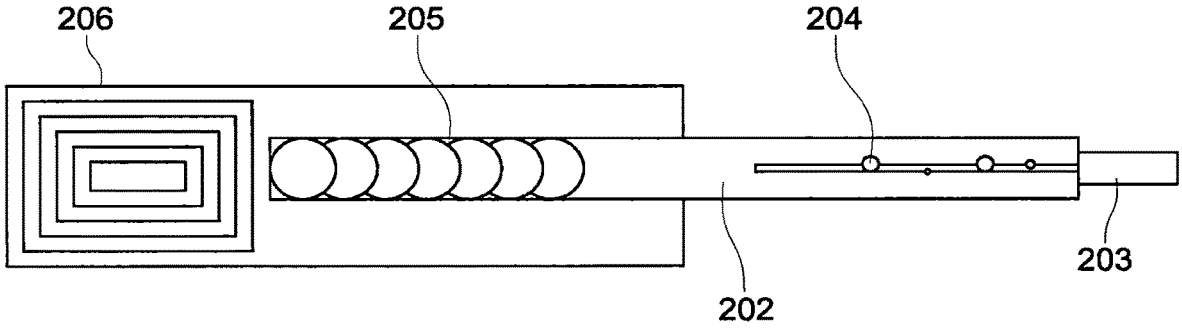
FIG. 2 is a drawing of the facemask attachment.

Looking to FIG. 2, the attachment mechanism, in one embodiment, uses a polymer urethane visco-elastic material 206, 106*a*, 106*b* such as Sorbathane to absorb the impact. Sobathane is described in a series of patents awarded to Dr. Maurice Hiles, including U.S. Pat. Nos. 4,101,704, 4,346,205, 4,476,258, and 4,808,469, each of these patents incorporated herein by reference. In other embodiments, the Sorbathane could be replaced with Silicone, Neoprene, Norsorex, Rubber, Deflex, Gel-mec, Microsorb, Memory foam, Acoustic foam, or other similar material.

In another embodiment, a compression spring (helical, conical, or volute) 205, 105*a*, 105*b* is used to absorb the shock of an impact on the facemask. In other embodiments, an extension spring or a torsion spring could be used.

In another embodiment, a ball lock mechanism on a telescoping rail could be used to absorb the shock of the impact on the facemask. See U.S. Pat. No. 4,662,771A by Elverton Row and Charles Moore for a description of a telescoping mechanism with a ball lock mechanism, said patent incorporated herein by reference.

In still another embodiment, any combination of the ball lock mechanism 202, 203, 204, the spring 205 and the polymer urethane visco-elastic material 206 (or other shock absorptive material) could be used.

In the preferred embodiment, as seen in FIG. 2, the facemask 102 is attached to the facemask attachment 203. The facemask attachment 203 slides in a tube or rail 202, and is locked into place with a ball bearing 204. The attachment 203 and the tube or rail 202 are made of steel, rugged plastic, aluminum, or similar rugged material. The ball bearing is typically made of steel, although any other suitable material could be used (hard plastic, aluminum, etc.). In some embodiments, the ball bearing is supported with a spring that pushes the bearing into a slot in the attachment, similar to the ball locking mechanism in a socket set. In other embodiments, the bearing (or the tube or rail) deforms to allow movement of the attachment 203 and the tube or rail 202 when sufficient force is applied.

The tube or rail 202 is mechanically attached to a spring 205. The attachment could be through welding, screws, rivets, or similar. In the preferred embodiment, the spring 205 is made of steel, stainless steel, bronze, copper or other material. In some embodiments, the spring 205 is enclosed in soft plastic, cloth, hard plastic, or similar material.

The spring 205 is mechanically attached to the polymer urethane visco-elastic material 206 (Sorbathane or other shock absorptive material). This mechanical attachment could be with an adhesive such as a solvent based one-part polyurethane adhesive (such as Lord Corporation 7650) or a two-part polyurethane adhesive (Lord Corporation 7542A/B). Alternatively, Neoprene-based adhesives or cyanoacrylates (Crazy Glues or Super Glues) could be used. In some embodiments, the end of the spring 205 is bent into a "T" or an "L", with the top or bottom of the "T" or "L" molded into the polymer urethane visco-elastic material 206 in order to spread the force over a wider section of the polymer urethane visco-elastic material.

The polymer urethane visco-elastic material 206 is attached to the helmet 101 with an adhesive, such as a one- or two-part polyurethane, a Neoprene or a cyanoacrylate adhesive. In some embodiments, the surface of the helmet 101 could include molded posts or holes to provide additional mechanical support for the polymer urethane visco-elastic material to hold onto the helmet. The polymer urethane visco-elastic material will absorb the majority of the initial impact.

Figure 3:
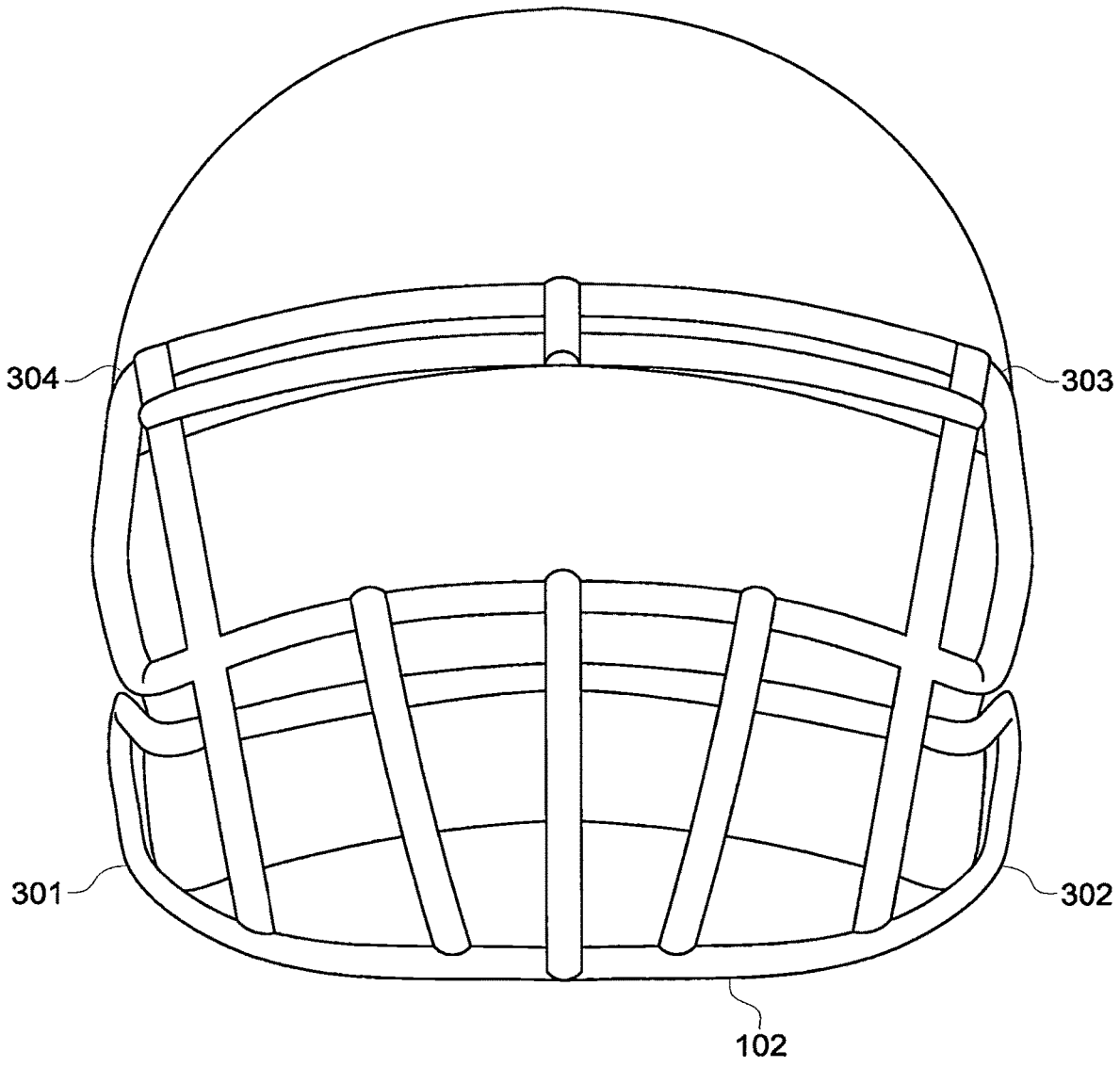
FIG. 3 is a drawing of a facemask with the attachment points.

In FIG. 3 a front view of the facemask 102 is shown. The four connecting spots 301, 301, 303, 304 are seen at the corners of the mask 102. Each of the four connecting spots 301, 302, 303, 304 have attachment mechanisms, the attachment mechanisms combining polymer urethane visco-elastic material with springs and the telescoping ball lock mechanism to provide maximum impact absorption.

Grommet and Block Embodiment

Figure 4:
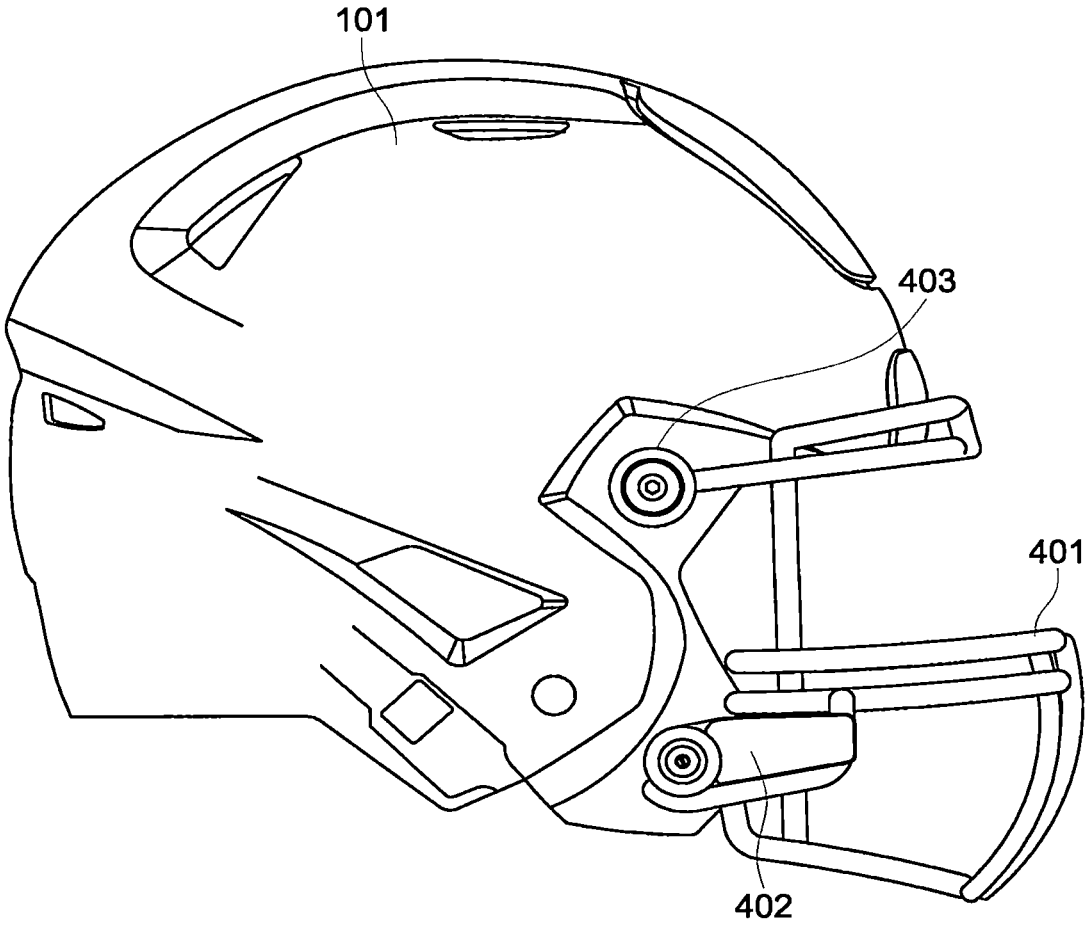
FIG. 4 is an image of a football helmet with an alternative shock absorption facemask attachment.

FIG. 4 is a drawing of an alternative embodiment for mounting a mask 401 on a helmet 101. In this embodiment, the top attachment 403 is a single point screw attachment inside of polymer urethane visco-elastic grommet that allows the mask to hinge upwards if necessary yet offers shock absorption. The details of this attachment are seen in FIGS. 6A-6B below. The bottom attachment is a block of polymer urethane visco-elastic material 402 that may contain a spring. This is detailed in FIGS. 5A-5C.

In this figure, notice that the mask 401 has a loop for connecting with the top attachment 403.

Figure 5A:
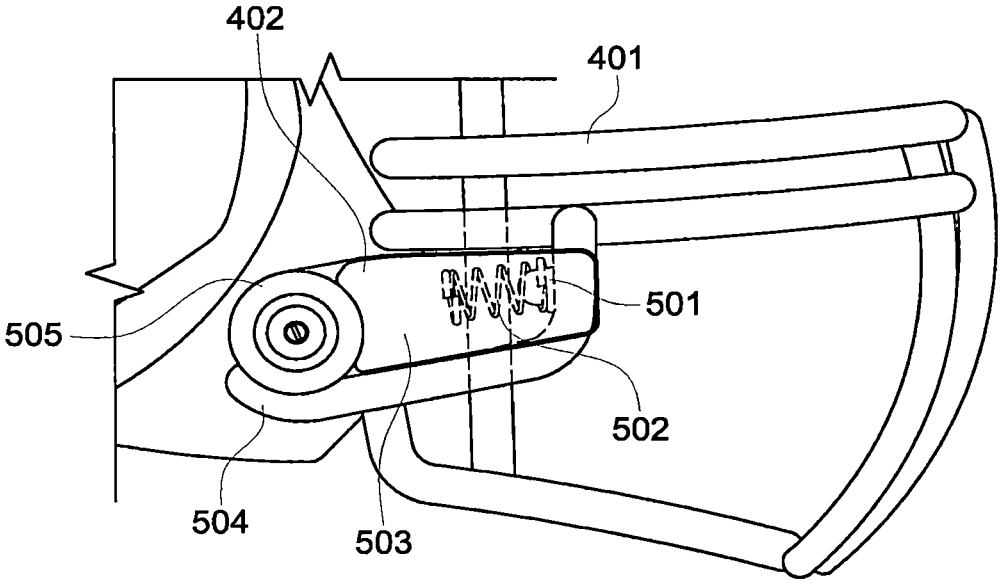
FIG. 5A is a drawing of the alternative lower shock absorption attachment.
Figure 6A:
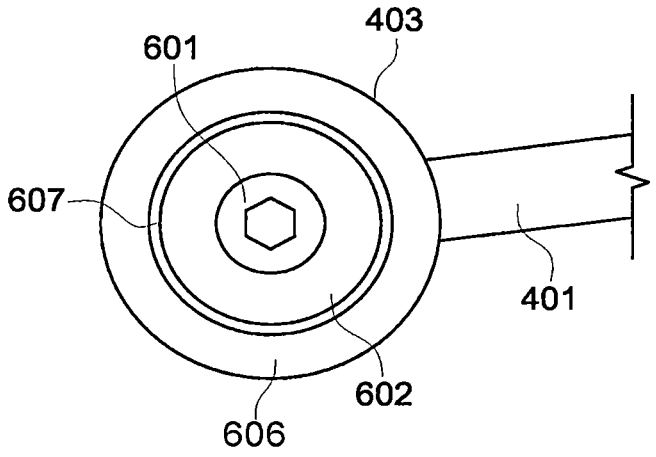
FIG. 6A is a drawing of the alternative upper shock absorption attachment.
Figure 6B:
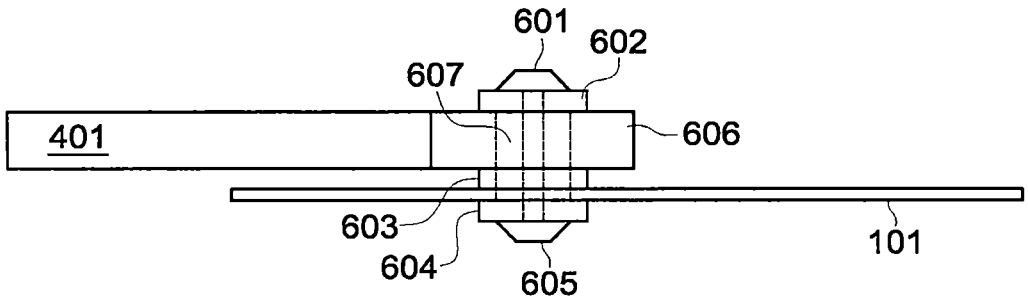
FIG. 6B is a cut away view of the alternative upper shock absorption attachment.

FIG. 5A shows the lower attachment in further detail. The lower attachment 402 includes a spring 502, a screw 505, and a polymer urethane visco-elastic structure 503. The mask 401, in this embodiment, has a J shaped wire structure 504 that surrounds the front, bottom, and some of the back of the bottom attachment 402. The front part of the J shaped structure 504 has a nub 501 for keeping the bottom attachment 402 and the spring 502 in place. The spring 502 is inside of a polymer urethane visco-elastic structure 503. The structure 503 continues backward beyond the screw 505. The structure 503 includes a hole so that the screw 505 can go through the structure 503. Screw 505 could include a washer between the screw 505 and the structure 503. A washer could be placed in between the structure 503 and the helmet 101. On the inside of the helmet, a nut and perhaps a washer are used to secure the lower attachment 402 to the helmet 101. The nut could be a T-nut so that there is additional threads for the screw to hold, and so that the screw-nut combination has a smooth exterior as it goes through the structure 503. The structure 503 is roughly rectangular when viewed from the side. In another embodiment, the screw 505 could be replace with a rivet or a snap mechanism.

Figure 5B:
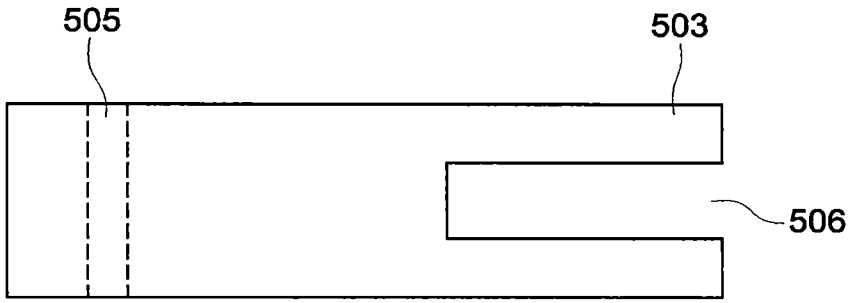
FIG. 5B is a view of the top of the lower shock absorption attachment device.

The polymer urethane visco-elastic structure 503 from a top view can be seen in FIG. 5B. The shape of the structure 503 is rectangular cuboid with a rectangular slit 506 in the side. The structure 503 has a hole for the screw 505 towards the rear.

Figure 5C:
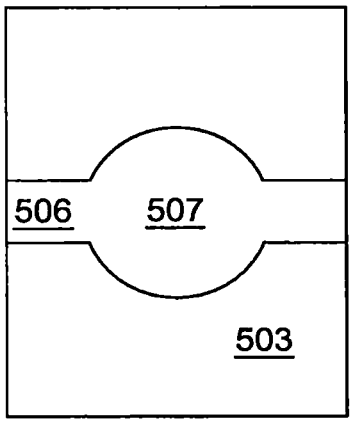
FIG. 5C is an end on view of the lower shock absorption attachment device.

FIG. 5C shows a view of the structure 503 from the front. From this view, the structure 503 is almost square. The slit 506 can be seen going across the structure. In addition, a round hole 507 for holding the spring 502. The slit 506 and the hole 507 extend about 40% of the way from the front of the structure 503 backwards.

In each of FIGS. 5A, 5B, and 5C have geographic shapes described above. Each of these shapes are approximate and can be rounded or modified without detracting from the invention herein.

FIGS. 6A and 6B show the top attachment mechanism 403. This top attachment mechanism 403 uses a polymer urethane visco-elastic grommet 607 to soften the impact on the mask 401 while allowing the mask 401 to swing upwards if necessary.

FIG. 6A shows the side view of the top attachment mechanism 403. The mask 401 has a loop 606. Loop 606 surrounds the polymer urethane visco-elastic grommet 607. The grommet 607 and the loop 606 are held to the helmet 101 with a screw 601. The screw 601 could have a large head or could have a washer 602 beneath it.

FIG. 6B shows a cross section of the top attachment mechanism 403. The screw 601 runs through an optional washer 602, the grommet 607 inside of the loop 606, a second optional washer 604, the wall of the helmet 101, a third optional washer 604 and the nut 605. The nut 605 could be a T-nut so that there is additional threads for the screw 601 to hold, and so that the screw-nut combination has a smooth exterior as it goes through the grommet 607. The grommet 607 is a right circular hollow cylinder shape, where the hollow in the cylinder is sized for the screw 601. In another embodiment, the screw 601 could be replace with a rivet or a snap mechanism.

Optionally, the grommet 607 is an "I" shaped structure, broader at the top and bottom, where the broader areas replace the washers. The grommet 607 could go through both the loop 606 and the helmet 101 in one embodiment, or the grommet 607 could go through only the loop 606 in another embodiment.

U-Spring Embodiment

Figure 7:
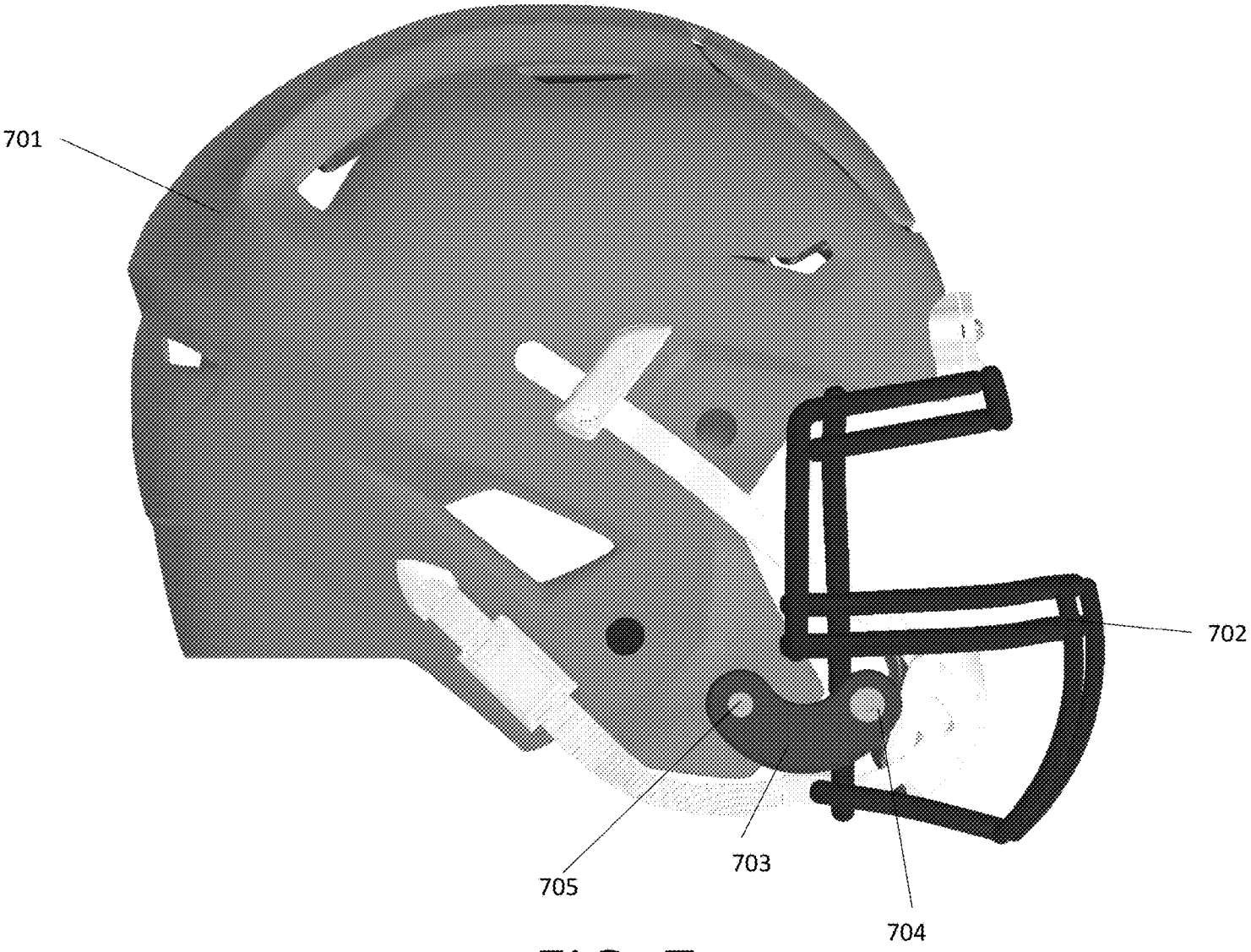
FIG. 7 is a side view of a football helmet with a third embodiment shock absorption facemask attachment.

A third embodiment is seen in FIGS. 7-12. In this embodiment, as seen in FIG. 7, a U shaped polymer urethane visco-elastic attachment apparatus 703 is attached to the helmet 701 with a helmet screw 705. The other side of the U shaped apparatus 703 is attached to the mask 702 with the mask screw 704. The mask screw 704 and the helmet screw 705 could be made of steel, rugged plastic, aluminum, or similar rugged material. The mask screw 704 and the helmet screw 705 could be a self-taping screw, a screw with a nut, a screw with a T-nut, a rivet, a snapping mechanism, or similar in other embodiments. In some embodiments, the screw head 704, 705 has ridges to allow tightening without tools. The screw head 704, 705 could also allow the use of a flat head screwdriver, a Philips screwdriver, an Allen wrench, a star bit for a screwdriver, or similar. In some embodiments the screw head 704, 705 and nut end are covered by a cap made of rubber, plastic, polymer urethane visco-elastic, or similar material.

Figure 8:
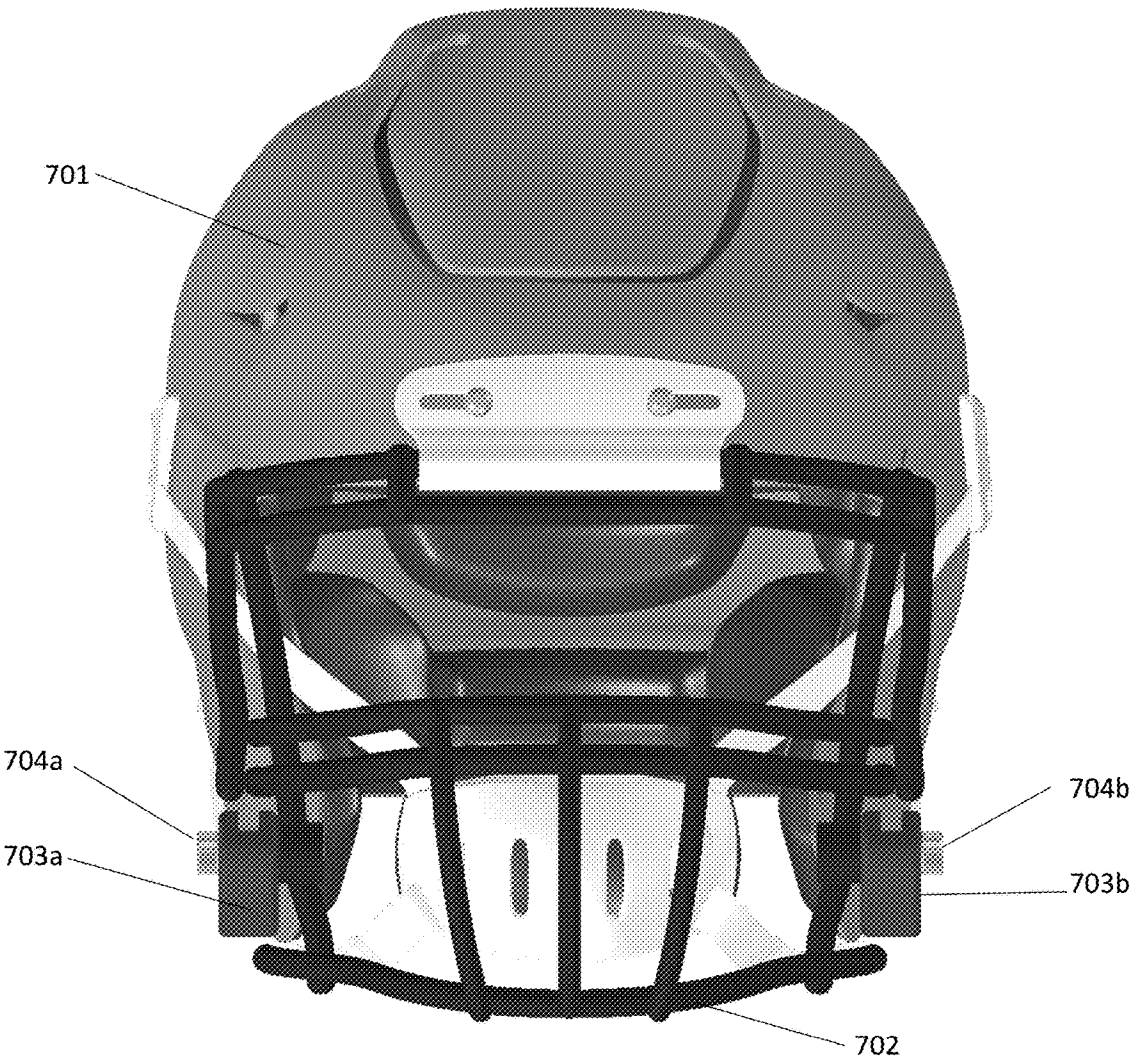
FIG. 8 is a front view of a football helmet with the third embodiment shock absorption facemask attachment.

FIG. 8 is a front view of the mask with the U shaped polymer urethane visco-elastic attachment apparatus 703*a*, 703*b* seen from the front. The left side of the helmet 701 has the left U shaped apparatus 703*a* held to the left side of the mask 702 with the left mask screw 704*a*. The right side of the helmet 701 has the left U shaped apparatus 703*b* held to the right side of the mask 702 with the right mask screw 704*b*.

Figure 9:
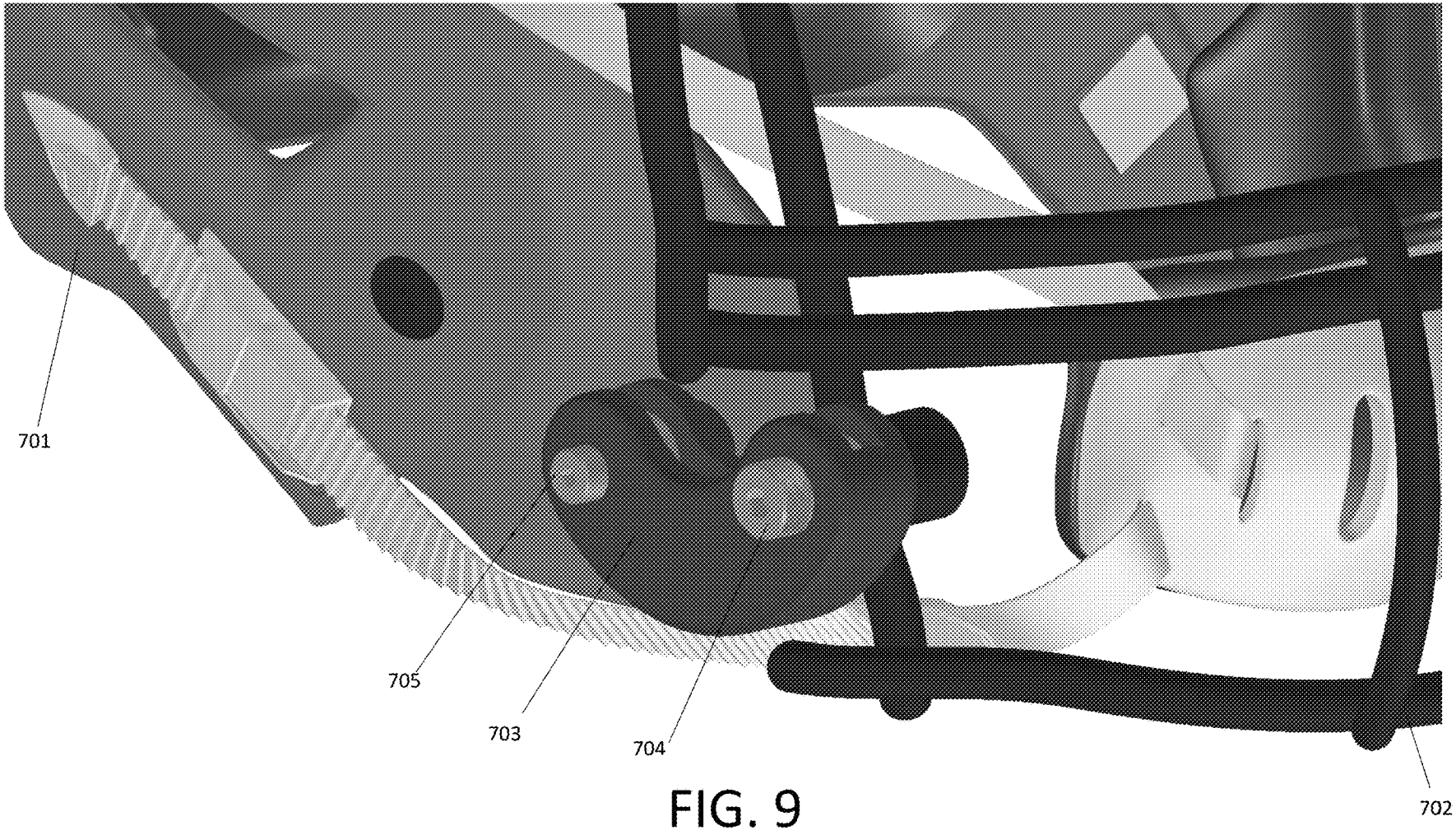
FIG. 9 is a close up side view of the third embodiment shock absorption attachment.

FIG. 9 is a close up of the U shaped polymer urethane visco-elastic attachment apparatus 703, showing the helmet screw 705 and the mask screw 704, holding the mask 702 on the helmet 701.

Figure 10B:
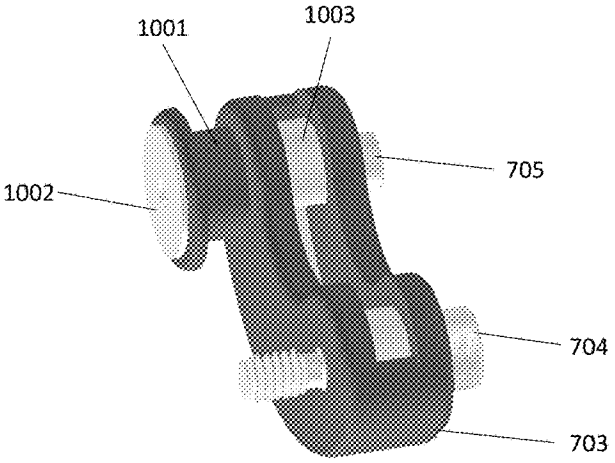
FIG. 10B is a prospective view of the third embodiment of the left shock absorption attachment apparatus.
Figure 10A:
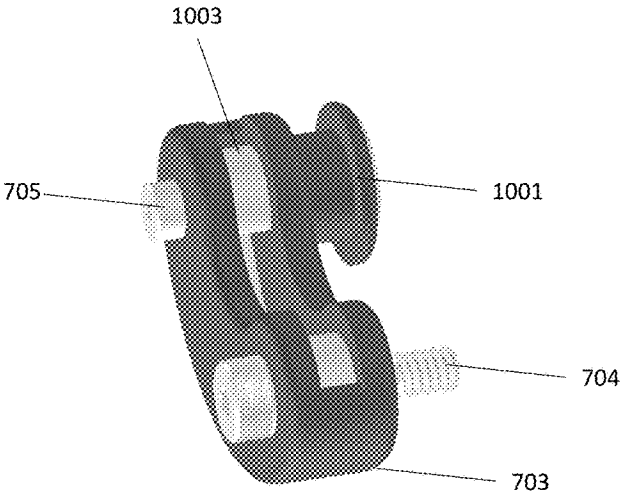
FIG. 10A is a prospective view of the third embodiment of the left shock absorption attachment apparatus.

In FIGS. 10*a*, the U shaped polymer urethane visco-elastic attachment apparatus 703 is shown configured for the left side of the mask/helmet. The U shaped apparatus is 703 is symmetrical in some embodiments, and can be switched between sides by flipping the direction of the screws 704, 705. In the shown embodiment, the mask screw 704 screws into threads in the mask 702. In other embodiments, a T-nut is used to hold the mask 702 to the mask screw 704. The helmet screw 705 runs through the U shaped apparatus 703 and through a grommet 1001. The grommet 1001 is held to the U shaped apparatus 703 with the helmet screw 705 and a T-nut 1002. The grommet 1001 could be made of polymer urethane visco-elastic material similar to the polymer urethane visco-elastic grommet 607 in FIGS. 6A and 6B. The grommet 1001 could also be made of rubber, plastic, or other shock absorption materials.

In FIGS. 10A and 10B the shape of the U shaped polymer urethane visco-elastic apparatus 703 can be seen. The width of the U shaped apparatus 703 has a slot about 33-50% wide in the center of the top of the U. This slot is about 60-75% deep, and a spring 1003 can be seen in the slot.

The spring 1003 is a flat spring made of spring steel or similar material, and it is in a semi-circular shape with the ends rolled around the helmet screw 705 and the mask screw 704.

FIG. 10B shows the U shaped apparatus 703 configured for the right side of the helmet.

Figure 11:
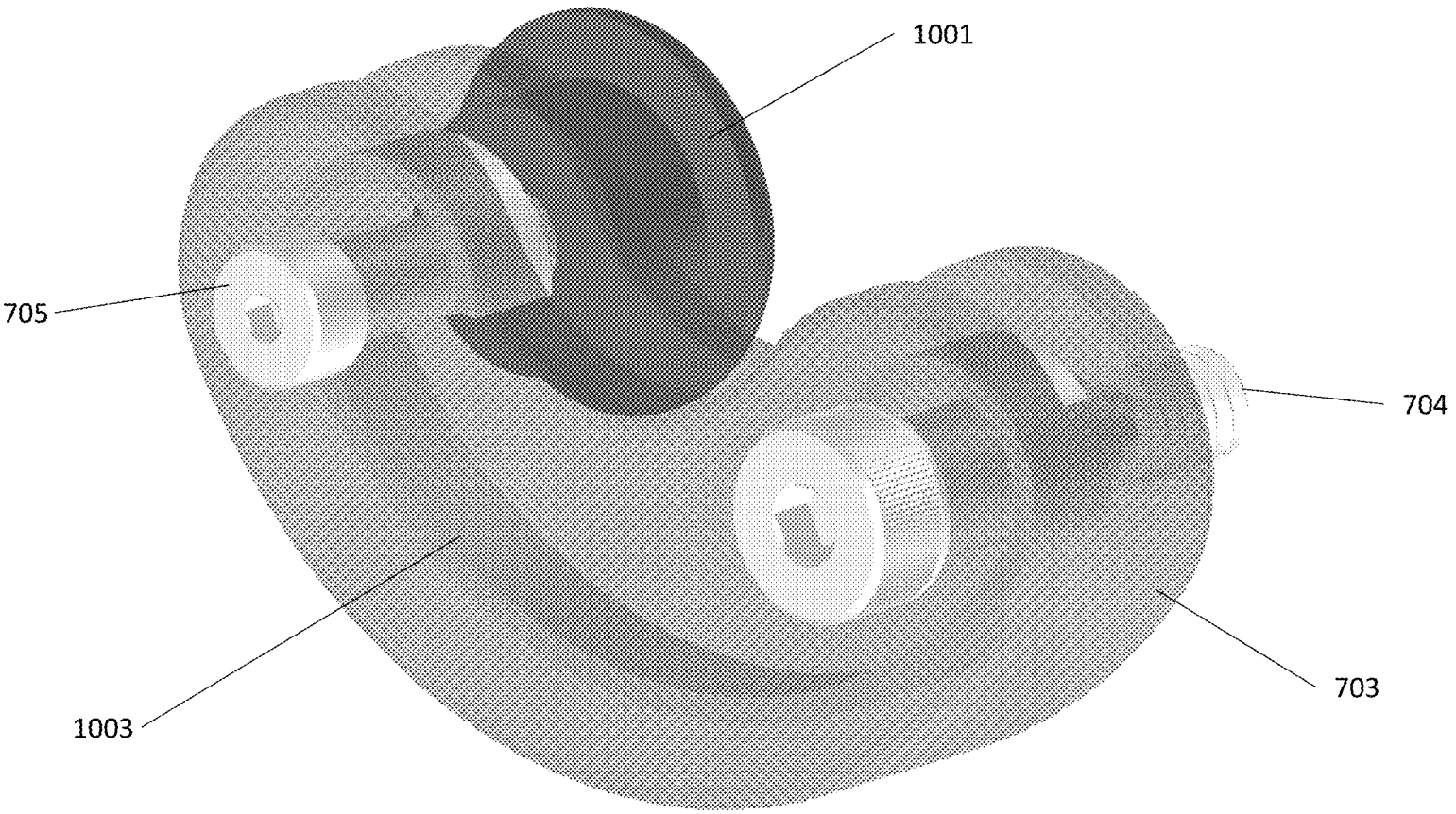
FIG. 11 is a prospective view of the third embodiment of the left shock absorption attachment apparatus in transparent form showing the internal structure.

FIG. 11 shows the U shaped apparatus 703 transparent, so that the spring 1003 can be seen inside of the polymer urethane visco-elastic material. The location of the helmet screw 705 and the mask screw 704 relative to the spring 1003 can be seen in this drawing.

Figure 12:
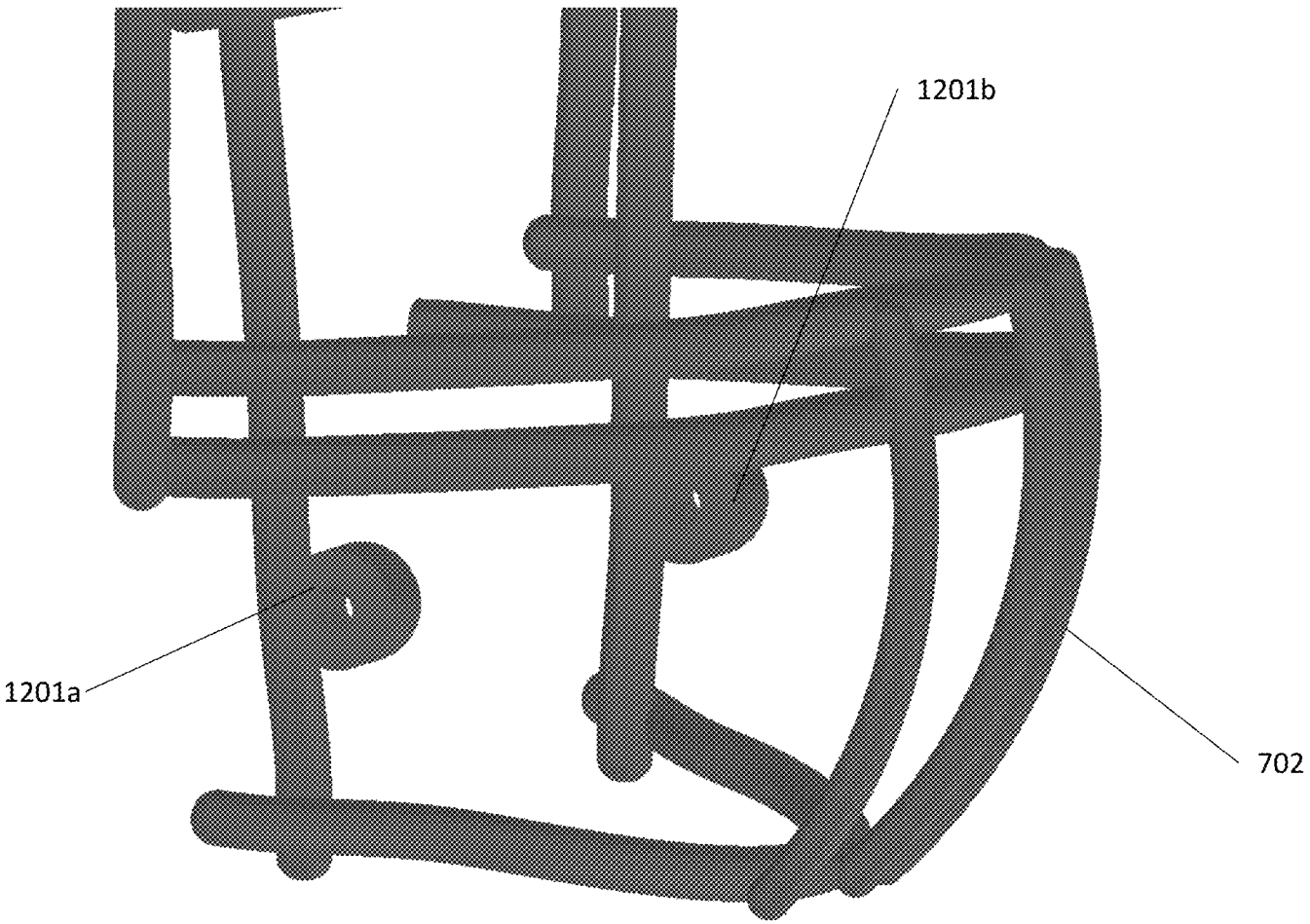
FIG. 12 is a prospective view of a facemask showing where the third embodiment of the attachment apparatus connects to the mask.

FIG. 12 shows the mask 702 with the two loops 1201*a*, 1201*b* for receiving the mask screw 704. In some embodiments, the loops 1201*a*, 1201*b* are threaded so that the mask screw 704 can tap into the loops 1201*a*, 1201*b*. In other embodiments, the loops 1201*a*, 1201*b* are not threaded, and a T-nut is used to connect to the mask screw 704, holding the U shaped apparatus 703 to the mask 704. In still another embodiment, a polymer urethane visco-elastic grommet similar to the polymer urethane visco-elastic grommet 607 in FIGS. 6A and 6B could be used in conjunction with a T-nut.

The foregoing devices and operations, including their implementation, will be familiar to, and understood by, those having ordinary skill in the art.

The above description of the embodiments, alternative embodiments, and specific examples, are given by way of illustration and should not be viewed as limiting. Further, many changes and modifications within the scope of the present embodiments may be made without departing from the spirit thereof, and the present invention includes such changes and modifications.

The invention claimed is:

1. An apparatus for attaching a helmet to a facemask, the apparatus comprising:
   - a polymer urethane visco-elastic structure in a U shape on each of two sides where the two sides are parallel, the structure resting against the facemask and against the helmet, wherein the structure has a slot removed from a side perpendicular to the U shape, inside of the U shape;
   - a first screw inserted in the structure and through a first hole in the helmet;
   - a first nut connected to the first screw;
   - a second screw inserted in the structure and through a first loop in the facemask; and
   - a second nut connected to the second screw.

2. The apparatus of claim 1 wherein the structure has spring inserted in the slot.

3. The apparatus of claim 2 wherein the spring is a flat spring.

4. The apparatus of claim 2 wherein the first screw and the second screw are inserted through a loop in the spring.

5. The apparatus of claim 1 wherein the helmet is an American football helmet.

6. The apparatus of claim 1 wherein the helmet is a hockey helmet.

7. The apparatus of claim 1 wherein the helmet is a lacrosse helmet.

8. The apparatus of claim 1 wherein the helmet is a baseball helmet.

9. The apparatus of claim 1 wherein the helmet is a motorcycle helmet.

10. An apparatus for attaching a helmet to a facemask, the apparatus comprising:

a polymer urethane visco-elastic structure in a U shape on each of two sides where the two sides are parallel, the structure resting against the facemask and against the helmet;

a first screw inserted in the structure and through a first hole in the helmet;

a first nut connected to the first screw;

a second screw inserted in the structure and through a first loop in the facemask;

a second nut connected to the second screw; and a polymer urethane visco-elastic grommet in a shape of a right circular hollow cylinder, placed tightly within the first hole in the helmet, where the first screw is inserted in the grommet and through a hole in the helmet, held in place with the first nut.

11. The apparatus of claim 1 wherein the first nut is a T-nut.

12. An apparatus for attaching a helmet to a facemask, the apparatus comprising:

a polymer urethane visco-elastic structure in a U shape on each of two sides where the two sides are parallel, the structure resting against the facemask and against the helmet;

a first screw inserted in the structure and through a first hole in the helmet;

a first nut connected to the first screw;

a second screw inserted in the structure and through a first loop in the facemask;

a second nut connected to the second screw; and a polymer urethane visco-elastic grommet in a shape of a right circular hollow cylinder, placed tightly within the first loop in the facemask, where the second screw is inserted in the grommet and through the first loop in the facemask, held in place with the second nut.

13. The apparatus of claim 1 wherein the second nut is a T-nut.

14. A method of connecting a facemask to a helmet, comprising:

inserting a first screw through a polymer urethane visco-elastic structure, through a polymer urethane visco-elastic grommet, and through a hole in the helmet, there the structure is in a U shape on each side, and where the two sides are parallel, the structure resting against the helmet;

connecting a first nut to the first screw, thereby holding the structure to the helmet;

inserting a second screw through the structure and through a loop in the facemask; and connecting a second nut to the second screw, thereby holding the structure to the facemask.

15. The method of claim 14 wherein the structure has a slot removed from a side perpendicular to the U shape, inside of the U shape.

16. The method of claim 15 wherein the structure has spring inserted in the slot.

17. The method of claim 16 wherein the spring is a flat spring.

18. The method of claim 16 wherein the first screw and the second screw are inserted through a loop in the spring.

19. The method of claim 14 wherein the helmet is an American football helmet.

* * * * *